US010519745B2

(12) United States Patent
Merrill et al.

(10) Patent No.: US 10,519,745 B2
(45) Date of Patent: Dec. 31, 2019

(54) MAGNETIC FLOW VALVE FOR BOREHOLE USE

(71) Applicant: BAKER HUGHES, A GE COMPANY, LLC, Houston, TX (US)

(72) Inventors: Steven R. Merrill, Houston, TX (US); Yash Parekh, Houton, TX (US); Steve Rosenblatt, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 202 days.

(21) Appl. No.: 15/485,779

(22) Filed: Apr. 12, 2017

(65) Prior Publication Data

US 2018/0298724 A1 Oct. 18, 2018

(51) Int. Cl.

| | |
|---|---|
| ***E21B 34/08*** | (2006.01) |
| ***E21B 34/10*** | (2006.01) |
| ***E21B 33/129*** | (2006.01) |
| ***E21B 33/12*** | (2006.01) |

(52) U.S. Cl.

CPC ..... *E21B 34/08* (2013.01); *E21B 33/1208* (2013.01); *E21B 33/1292* (2013.01); *E21B 33/1294* (2013.01); *E21B 34/102* (2013.01)

(58) Field of Classification Search

CPC ..... E21B 33/1208; E21B 33/1292; E21B 33/1294; E21B 34/08; E21B 34/102

USPC ..... 137/517, 519, 529

See application file for complete search history.

(56) References Cited

U.S. PATENT DOCUMENTS

| | | | | |
|---|---|---|---|---|
| 3,495,620 | A * | 2/1970 | Bazell | F16K 31/08 137/529 |
| 4,974,624 | A | 12/1990 | Gotanda | |
| 5,101,949 | A | 4/1992 | Takikawa et al. | |
| 6,394,180 | B1 | 5/2002 | Berscheidt et al. | |
| 7,255,323 | B1 * | 8/2007 | Kadhim | F16K 17/26 137/529 |
| 7,740,079 | B2 | 6/2010 | Clayton et al. | |
| 8,191,635 | B2 | 6/2012 | Buske et al. | |
| 8,720,540 | B2 | 5/2014 | Gano | |
| 8,955,605 | B2 | 2/2015 | Vanlue | |
| 9,062,516 | B2 | 6/2015 | Fripp et al. | |
| 9,316,086 | B2 | 4/2016 | Vanlue | |
| 9,322,233 | B2 | 4/2016 | Wilson | |
| 2003/0010847 | A1 * | 1/2003 | Curran | F02M 51/0664 239/585.1 |
| 2006/0151030 | A1 * | 7/2006 | Bonne | F16K 15/028 137/517 |
| 2009/0151790 | A1 | 6/2009 | Ranjan et al. | |

(Continued)

*Primary Examiner* — Caroline N Butcher

(74) *Attorney, Agent, or Firm* — Shawn Hunter

(57) ABSTRACT

A valve for a plug passage features opposed perforated magnetic discs that repel each other to stay apart allowing flow through the openings of the spaced discs. When a predetermined flow rate is exceeded, the magnetic repelling force is overcome and one disc moves toward the other to shut off flow as contact between the discs closed the openings between them. One way is to offset the openings and guide the moving disc axially while rotationally locking the moving disc. Another way is to spirally guide the moving disc so that openings initially aligned rotate out of alignment. One or more edge slots can be provided in each disc to sweep out debris that can settle between the discs that would otherwise impede the moving disc from contacting the stationary disc for passage closure.

18 Claims, 2 Drawing Sheets

(56) References Cited

U.S. PATENT DOCUMENTS

| | | | | |
|---|---|---|---|---|
| 2010/0006788 | A1 | 1/2010 | Tanner et al. | |
| 2012/0031617 | A1* | 2/2012 | Xu | E21B 21/10 166/305.1 |
| 2015/0101796 | A1 | 4/2015 | Davies et al. | |
| 2015/0267502 | A1 | 9/2015 | Vanlue | |
| 2016/0145957 | A1 | 5/2016 | Davies et al. | |
| 2016/0208580 | A1 | 7/2016 | Delzell et al. | |

* cited by examiner

MAGNETIC FLOW VALVE FOR BOREHOLE USE

FIELD OF THE INVENTION

The field of the invention is treatment plugs and more specifically where the passage through the plug for treatment is closed with fluid flow overcoming magnetic force from repelling magnets.

BACKGROUND OF THE INVENTION

Various devices in downhole applications and in other fields use magnetic attraction or repulsion to accomplish various tasks. Some send a magnetic sonde downhole to trigger a valve to open simply from passing by, as is disclosed in U.S. Pat. No. 9,062,516. Other downhole applications mechanically move magnets between attracting and repelling orientations such as U.S. Pat. Nos. 9,322,233; 8,720,540 and US 2016/0208580. U.S. Pat. No. 8,191,634 uses repelling magnets as a shock absorber for a flapper type safety valve. US 2009/0151790 uses magnets to reposition a choke valve. Outside of downhole application magnetic force is used to close valves or passages as indicated in US 20100006788; U.S. Pat. Nos. 4,974,624 and 5,101,949.

Of more general interest are U.S. Pat. Nos. 6,394,180; 7,740,079; 8,955,605; 9,316,086; U.S. Patent Publication 2015/0101796; U.S. Patent Publication 2015/0267502 and U.S. Patent Publication 2016/0145957.

The present invention takes away the need to drop a ball and get it to land on a seat around a passage in a plug when performing a treatment that involves multiple plugs. In the past designs have been offered to loosely trap a ball above a seat using a spring to hold the ball off the seat until a predetermined flow creates a large enough reaction force to compress the spring and land the ball on the seat for a pressure treatment in the formation against the seated ball. While this design saves the time of delivery of the ball to the seat it presents other design issues which can be considerable drawbacks. For one there is the issue of the spring coils filling with debris which can prevent sufficient ball movement to reach the seat. The spring has its upper end laterally unsupported which can mean that the ball can spread the spring end apart rather than compressing the spring as desired with a result that the ball will again fail to reach the seat. Over long periods of use the spring can weaken and allow the ball to seat at an inopportune time. The advantages of using a magnet versus a spring/ball/cage system are: milling a spring can be difficult or can cause issues; more flow is achievable with openings in magnets than springs and the flow rate that triggers magnet movement is customizable and erosion can be a serious problem with springs which can be avoided with magnets.

The present invention keeps the path open to flow to a predetermined value with the force of repelling magnets keeping discs apart that have offset holes. One disc is guided for axial movement driven by fluid flow through its ports until a net force from flow is developed on the movable disc. Axial movement of one disc abuts the pair of discs and closes the ports due to their offset nature on the disc pair. The magnetic force is overcome to allow axial movement of one disc. On reduction of flow the magnetic force repels one disc to allow flow to resume. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A valve for a plug passage features opposed perforated magnetic discs that repel each other to stay apart allowing flow through the openings of the spaced discs. When a predetermined flow rate is exceeded, the magnetic repelling force is overcome and one disc moves toward the other to shut off flow as contact between the discs closed the openings between them. One way is to offset the openings and guide the moving disc axially while rotationally locking the moving disc. Another way is to spirally guide the moving disc so that openings initially aligned rotate out of alignment. One or more edge slots can be provided in each disc to sweep out debris that can settle between the discs that would otherwise impede the moving disc from contacting the stationary disc for passage closure.

DETAILED DESCRIPTION OF THE PREFERRED EMBODIMENT

Figure 1:
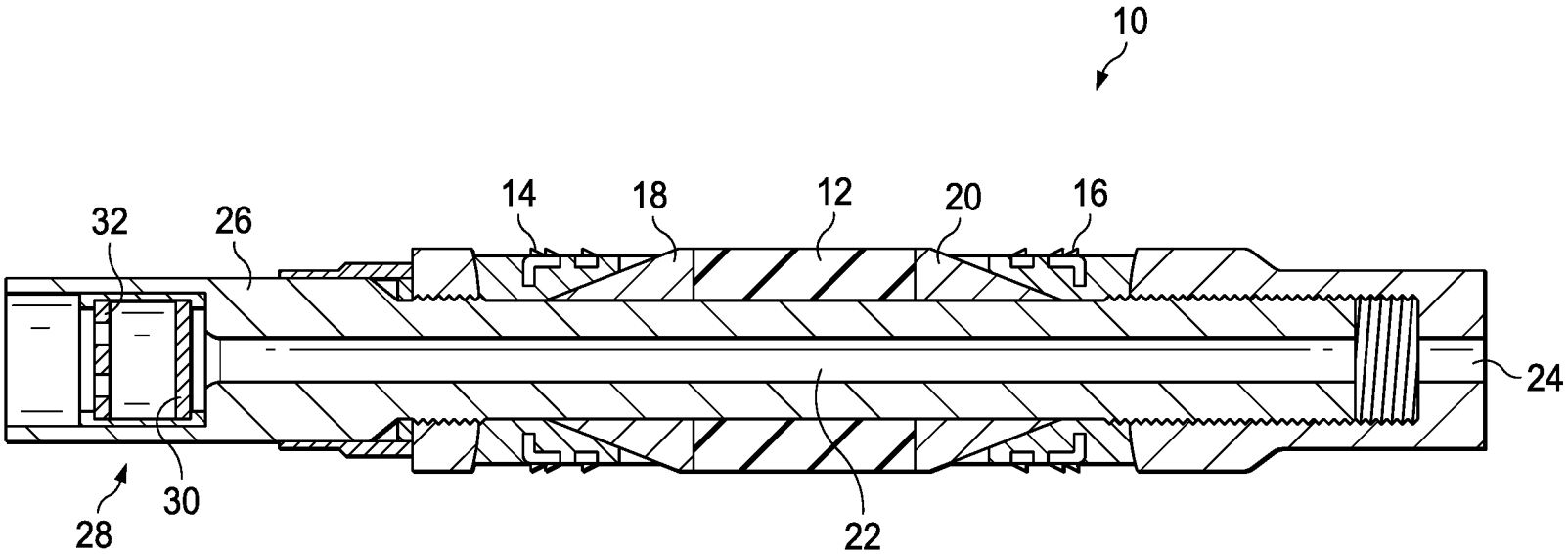
FIG. 1 is a section view of a compression set plug having a through passage with the magnetic valve located in an uphole end and shown in an open position

FIG. 1 illustrates a compression set treatment plug 10 with a sealing element 12 and upper slips 14 and lower slips 16. Cones 18 and 20 on opposed sides of the sealing element 12 guide the slips 14 and 16 against a borehole wall that is not shown that can be open or cased hole. Passage 22 extends through the mandrel 26 to a lower end 24 below the sealing element 12 to facilitate running in and then setting the sealing element 12. After the sealing element 12 is set there is a need to isolate that lower zone and repeat the process in the next zone uphole to be treated. The zone below is isolated with valve 28 in passage 22.

Figure 2:
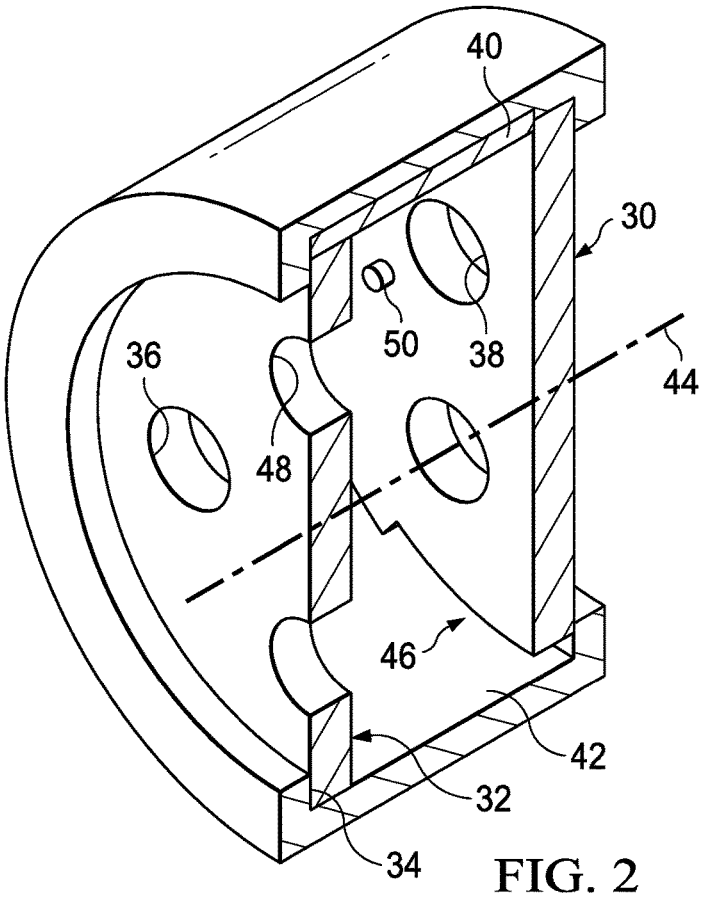
FIG. 2 is a part section view in perspective showing the openings in the spaced apart magnetic discs.
Figure 3:
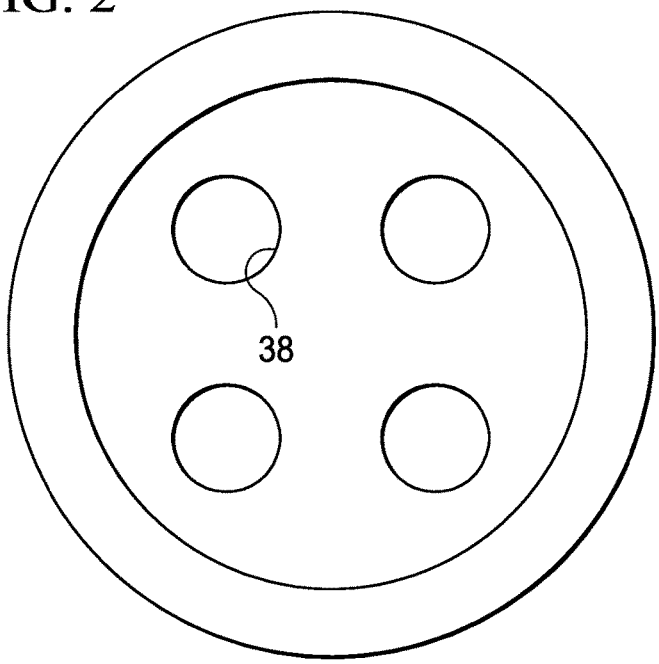
FIG. 3 is an end view of one of the magnetic disc showing a four hole pattern.

Valve 28 has magnetic discs 30 and 32. While flat discs are preferred any nesting shapes will work. Preferably disc 30 is stationary and disc 32 moves axially. The orientation of discs 30 and 32 is such that their north and south poles are positioned for repelling disc 32 by disc 30 to put disc 32 against a stop 34 best seen in FIG. 2. Each disc has openings with four shown in disc 30 as 38 and four shown in disc 32 as 36. The openings can be lined with a replaceable liner sleeve to allow reuse of the discs. Although round openings are shown other shapes are contemplated and the number of openings in each disc 30 and 32 can be more than four or less. The number of openings in each disc need not be identical as long as when the discs 30 and 32 are pushed toward each other the passage through the disc is substantially closed. There are a number of ways to do this. The movement of disc 32 in response to sufficient flow to overcome the magnetic repelling force can be purely axial with one or more keys shown schematically as 40 allowing only axial movement without rotation. In that event the openings 36 and 38 need to be sufficiently offset in any direction so that when the disc 32 advances toward disc 30 the flow paths through the discs are substantially obstructed. It should be noted that to facilitate the treatment of the next zone in an uphole direction there need not be a perfect seal through valve 28 and some leakage flow is tolerated if enough volume at the needed pressure can be directed in the next zone uphole to be treated. Ideally the openings should preferably not overlap when the disc 32 is against disc 30. It should be noted that the offset axes of the openings in the discs causes flow to turn after passing disc 32 when the hole axes in both discs are parallel. While this causes an increase in pressure drop for flow with the discs 30 and 32 in the FIG. 1 position an advantage is that the change in flow direction between the discs causes greater turbulence between the discs in the FIG. 1 position to keep debris in suspension so that it does not accumulate between the discs 32 and 30.

A variation can be to align the openings 36 and 38 on a common axis but to guide the movement of disc 32 to rotate on its axis as it translates. The key 40 would be in a spiral orientation instead of straight and axially aligned. The rotation needs to only be enough to offset openings in adjacent discs while still leaving a repelling force between the discs 30 and 32 that are permanent magnets. Key 40 that can be straight and axially oriented or spirally oriented would be made of a non-magnetic material. As an option the inner wall 42 can be made of a non-magnetic material to facilitate the axial movement of disc 32.

As another variation the axes of holes 36 can be skewed with respect to the axis 44 of the passage 22 so that passing fluid is directed toward inner wall 42 to agitate debris and keep it from accumulating against disc 30 or to go through peripheral slots 46. These slots would be closed when disc 32 moves against disc 30. One or more such slot 46 can be provided as there may be uncertainty as to what part of the passage 22 will orient at the lower end of the borehole. Apart from skewing the axes of the openings 36 toward inside wall 42 the openings themselves can have a spiral pattern or some other pattern or surface roughness 48 to increase turbulence with an eye toward preventing debris from settling between the discs during flowing mode that could then prevent full movement of disc 32 against disc 30.

Those skilled in the art will appreciate that the valve 28 in its various implementations can remove the need to drop balls and avoid the shortcomings of a caged ball design held off a seat with a spring. The design is simple and yet reliable in the long term. Openings can be sized or shaped or provided in different quantities to allow a predetermined rate to pass with the magnetic repelling force holding the discs apart and when that flow rate is obtained, the force of the magnets repelling is overcome and the discs move together to substantially block the passage 22. As shown schematically by projection or depression 50 that mates with its opposite on disc 32 the two discs when together or close to each other can rotationally lock to facilitate milling out. Disc 30 although stationary can still be rotationally locked to wall 42 with a key that is not shown so that on milling out the disc 30 will be locked against rotation.

While the preferred treatment using the described device is fracturing, the teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc., all collectively included in a term "treating" as used herein. Another operation can be production from said zone or injection into said zone.

The above description is illustrative of the preferred embodiment and many modifications may be made by those skilled in the art without departing from the invention whose scope is to be determined from the literal and equivalent scope of the claims below:

We claim:

1. A valve assembly for a passage in a borehole treatment plug, comprising:

a mandrel with an external sealing element for selective borehole contact and further comprising a passage therethrough and a valve in said passage, said valve further comprising:

magnetic valve members which are movable relatively to each other in said passage each member of the magnetic valve members having at least one opening disposed through the member itself, said members repelled away from each other by magnetic repelling force to leave said passage open through said openings and said valve members moving relatively at a predetermined flow rate through said passage to overcome the magnetic repelling force so that said passage substantially closes at said openings.

2. The assembly of claim 1, wherein:

said relative movement is axial.

3. The assembly of claim 2, wherein:

said relative movement is guided against rotation.

4. The assembly of claim 3, wherein:

said openings on said valve members are misaligned.

5. The assembly of claim 4, wherein:

said mandrel is non-magnetic between said valve members.

6. The assembly of claim 4, wherein:

said openings on said valve members have parallel axes.

7. The assembly of claim 4, wherein:

said openings in at least one valve member have axes that skew from a longitudinal axis of said passage to direct flow passing therethrough to a wall defining said passage between said valve members.

8. The assembly of claim 4, wherein:

said openings in at least one valve member comprise a surface roughness to create turbulence between said valve members or a replaceable liner sleeve.

9. The assembly of claim 4, wherein:

one of said valve members is stationary and further comprises at least one peripheral slot, said slot substantially obstructed when said relative movement occurs, said slot allowing debris accumulating between said valve members to pass through said stationary valve member.

10. The assembly of claim 9, wherein:

said valve member that is stationary is further rotationally locked to the wall defining said passage.

11. The assembly of claim 9, wherein:

said valve members rotationally lock to each other when said relative movement brings said valve members close to each other.

12. The assembly of claim 1, wherein:

said valve members comprise flat discs with offset holes in a direction along a longitudinal axis of said passage.

13. The assembly of claim 12, wherein:

said openings in said valve members are round and are substantially the same diameter.

14. A borehole treatment method, comprising:

pumping fluid through a mandrel passage while a sealing element is extended to a borehole wall into a lower zone;

closing said mandrel passage using a valve further comprising magnetic valve members which are movable relatively to each other in said passage each member of said magnetic valve members having at least one opening disposed through the member itself, said members repelled away from each other by magnetic repelling force to leave said passage open through said openings and said valve members moving relatively at a predetermined flow rate through said passage to overcome the magnetic repelling force so that said passage substantially closes at said openings; and pumping fluid against said sealing element with said passage closed to treat an upper zone.

15. The method of claim 14, comprising:

making said relative movement axial.

16. The method of claim 15, comprising:

guiding said relative movement against rotation.

17. The method of claim 16, comprising:

misaligning said openings on said valve members.

18. The method of claim 17, comprising:

making said mandrel non-magnetic between said valve members.

* * * * *